United States Patent [19]

Gavit

[11] 4,257,328

[45] Mar. 24, 1981

[54] STRIP LABEL PRINTER

[76] Inventor: Stephan E. Gavit, 4832 W. Gill Pl., Denver, Colo. 80219

[21] Appl. No.: 40,160

[22] Filed: May 18, 1979

[51] Int. Cl.[3] ..... B41K 3/48; B41F 21/02; B41F 1/28

[52] U.S. Cl. ..... 101/292; 226/65; 226/87; 226/68

[58] Field of Search ..... 226/64, 65, 87, 101, 226/199, 62, 68; 101/288, 291, 292

[56] References Cited

U.S. PATENT DOCUMENTS

| | | | |
|---|---|---|---|
| 1,124,577 | 1/1915 | Allen | 226/68 |
| 1,352,144 | 9/1920 | Parkes | 226/68 |
| 2,125,626 | 8/1938 | Flood | 226/64 |
| 2,720,994 | 10/1955 | Arvidson | 226/64 |
| 2,889,768 | 6/1959 | Hampton | 101/288 |
| 3,027,834 | 4/1962 | Bilsky | 101/292 |
| 3,420,423 | 1/1969 | Surber, Jr. | 226/68 |
| 3,840,163 | 10/1974 | Diepeveen | 226/64 |
| 3,858,784 | 1/1975 | Diepeveen | 226/62 |
| 3,867,883 | 2/1975 | Styers et al. | 101/292 |

*Primary Examiner*—William Pieprz

*Attorney, Agent, or Firm*—Edwin L. Spangler, Jr.

[57] ABSTRACT

This invention relates to an improved strip label printer and especially to a shuttle mechanism therefor that advances the label strip in incremental fashion and, in addition, functions to actuate the printing head during the time the shuttle is returning to its original position preparatory to starting another label-advancing stroke. This shuttle mechanism is characterized by a specially-shaped slide block that includes label-engaging ears working through slots in a bedplate over which the label strip moves and also a hump-like fulcrum between these ears that engages the underside of the bedplate and functions to tilt the slide block in a direction as to elevate the ears into operative position during the forward stroke lowering them into inoperative position beneath the strip on the return stroke when shuttled back and forth by the crank and pitman drive therefor. The shuttle also includes a unique axially-adjustable shuttle deactivation mechanism which engages the slide block during a preselected portion of its forward stroke and delays the emergence of its ears into operative position until they reach the proper point to engage and advance the next label.

8 Claims, 10 Drawing Figures

Fig.-2
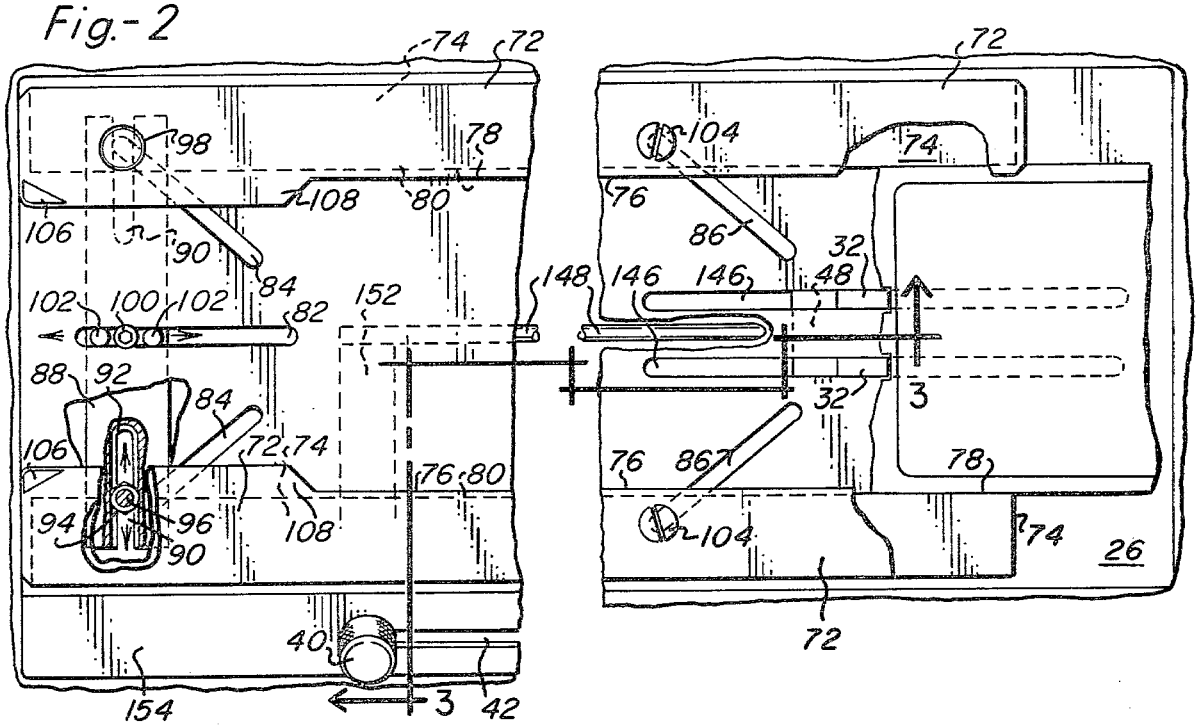
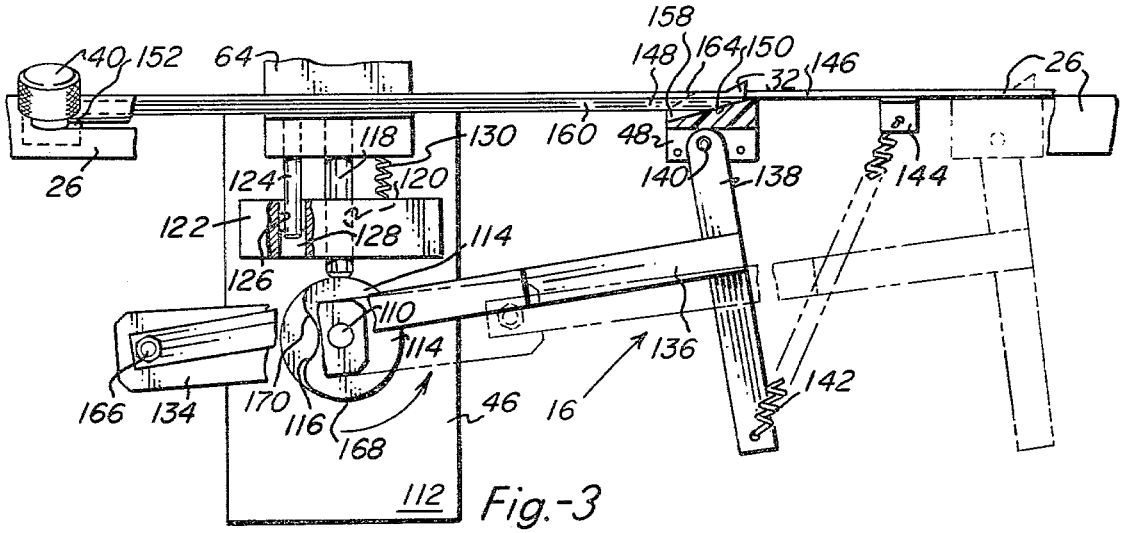
Fig.-3
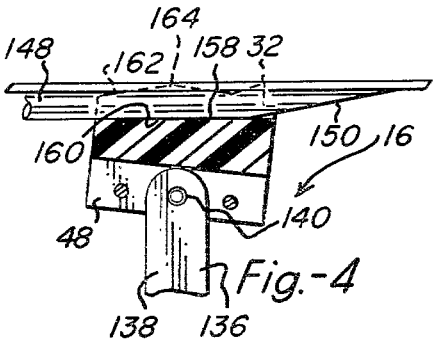
Fig.-4
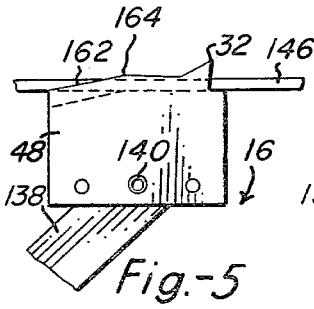
Fig.-5
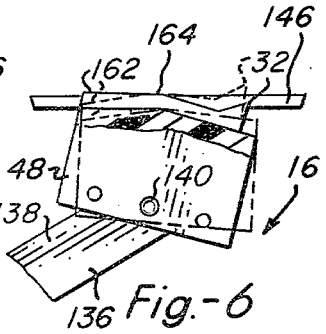
Fig.-6

STRIP LABEL PRINTER

A need exists for a simple and inexpensive printing apparatus for use in hospitals and like institutions for the purpose of printing up gummed labels for one-time use on disposable cups delivered to the patients. The ordinary label of the type printed by commercial printing establishments are totally unsuitable for this purpose because they are too expensive and, moreover, the information displayed thereon changes with each different drug.

The solution to this problem was recognized some time ago and is exemplified by the strip label printer forming the subject matter of Styers et al U.S. Pat. No. 3,867,883. In this patent, a small manually operated machine is revealed for printing strip labels from a stencil. The individual labels are interconnected in chain-like fashion by relatively narrower connecting portions that coacted with the label immediately ahead thereof to define a pair of rearwardly-facing shoulders. A crank and pitman drive was used to reciprocate a shuttle that had upstanding ears which contacted the aforesaid shoulders behind each label and used them as abutments for advancing the strip into position for the next label in the series to be printed.

In the intervening years since the Styers patent was granted, operational difficulties have arisen with respect to the shuttle mechanism that rendered it somewhat unsatisfactory. For instance, the shuttle ears came into direct contact with the rear edge of each label and all too often damaged them as it pushed thereagainst. Also, inadequate provision was made for accommodating labels of different lengths, shapes and heights.

It has now been found in accordance with the teaching of the instant invention that these and other shortcomings of the aforementioned strip label printer and other printing machines exemplified by the references of record listed therein can be overcome by the simple, yet unobvious, expedient of redesigning the slide block carrying the label-engaging ears of the shuttle subassembly by providing it with a hump-like fulcrum which coacts with the underside of the strip-supporting surface along which it rides and the crank and pitman driving same so as to rock back and forth between its operative strip-advancing position and a retracted inoperative one. In addition, a longitudinally-adjustable shuttle deactivation mechanism is provided which engages the slide block and holds its ears in retracted inoperative position over a preselected portion of its forward stroke thus delaying their becoming operative until they reach the precise location required for them to engage and advance each succeeding label regardless of its length. Improved adjustable strip guides are also used and the unit has been converted from manual to electric powered operation.

It is, therefore, the principal object of the present invention to provide a novel and improved strip label printer.

A second object is the provision of a mechanism of the class described which is used with an apertured backing strip atop which labels of various sizes, shapes and even thicknesses can be accommodated without effecting the operation of the strip-advancing shuttle mechanism.

Another objective of the within described invention is the provision of a novel means for deactivating the shuttle over a preselected portion of its forward or working stroke so as to accommodate strips with different hole spacings between adjacent labels.

Still another object is to provide a label printer of the type described which includes quickly adjustable strip guides that define a track effective to maintain the labels in proper alignment with the printing head at all times.

An additional object is to provide a mechanism for printing strip labels and the like that incorporates a completely unique flip-flop mechanism for activating and deactivating the strip-advancing shuttle.

Further objects are to provide a label printing machine of the type disclosed and claimed herein that is simple, versatile, compact, reliable, rugged, lightweight, easy to operate, trouble free and even decorative.

Other objects will be in part apparent and in part pointed out specifically hereinafter in connection with the description of the drawings that follows, and in which:

FIG. 2 is a fragmentary top plan view to an enlarged scale with portions thereof broken away both to conserve space and also to more clearly reveal the interior construction;

FIG. 3 is a fragmentary section taken along line 3—3 of FIG. 2 and to the same scale as the latter figure;

FIG. 4 is a still further enlarged fragmentary section showing how the slide block of the shuttle subassembly may be deactived over a portion of its forward stroke;

FIG. 5 is a fragmentary side elevation to the same scale as FIG. 4 showing the slide block of the shuttle subassembly in its operative position;

FIG. 6 is a fragmentary section to the same scale as FIGS. 4 and 5 showing the slide block as it rocks to and fro between its operative and inoperative positions at the completion of its forward stroke;

Figure 1:
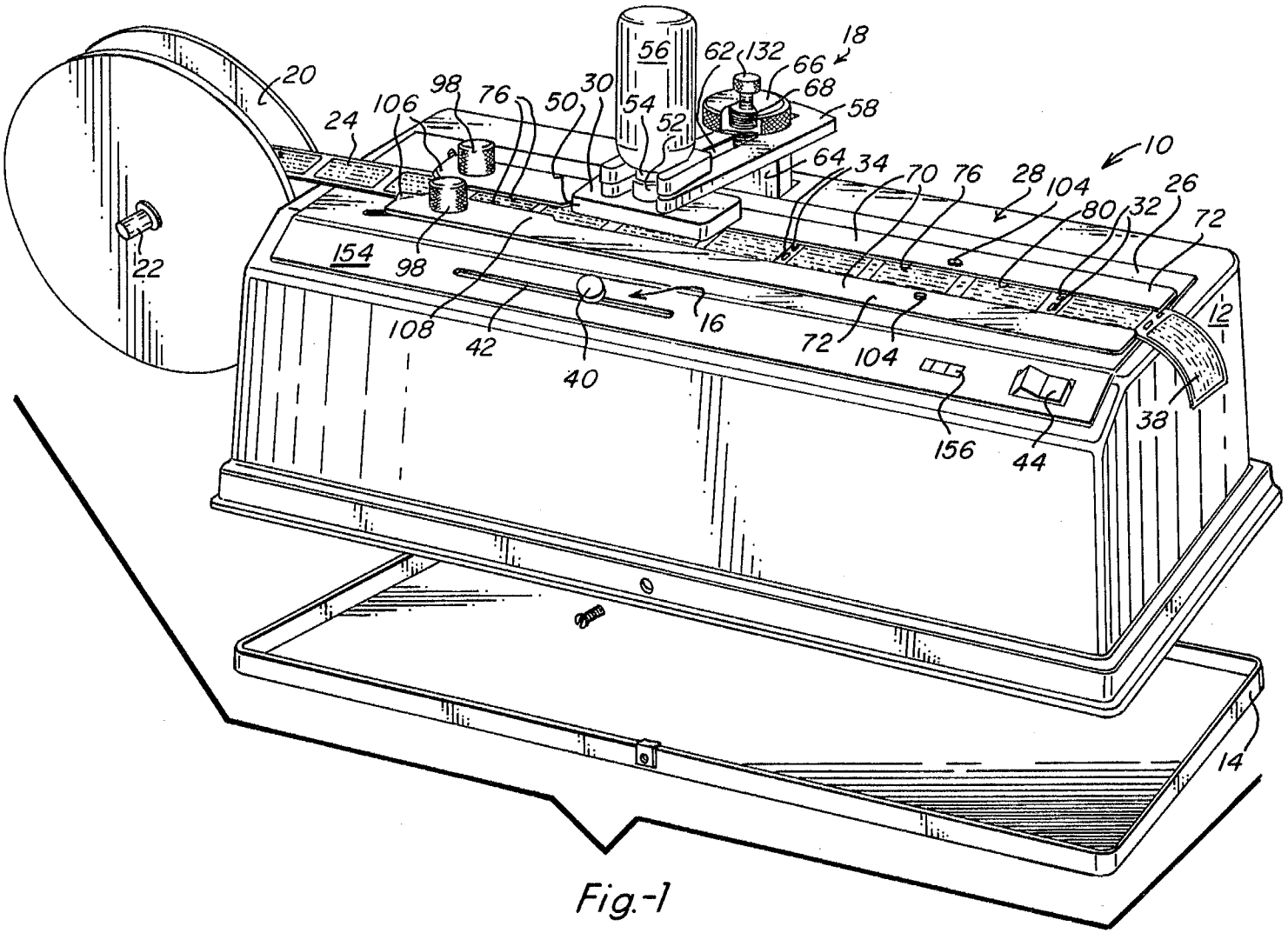
FIG. 1 is an exploded perspective view of the strip label printer of the present invention showing the bottom removed.

Referring next to the drawings for a detailed description of the present invention and, initially, to FIG. 1 for this purpose, reference numeral 10 has been chosen to broadly designate the strip label printer of the present invention and it will be seen to include a box-like case 12 with a removable bottom 14 that houses the shuttle and printing subassemblies which have also been referred to in a general way by reference numerals 16 and 18, respectively. A supply reel 20 is detachably mounted on a horizontally-disposed spindle 22 located at what, for purposes of the present description will be denominated the rear end of the unit in position to feed a strip of labels 24 longitudinally along bedplate 26 atop thereof where an adjustable label strip guide subassembly 28 is mounted. This subassembly, as will be explained in detail presently, overlies the side margins of the label strip and defines a track guiding it into position underneath the printing head 30.

Shuttle subassembly 16 includes a pair of ears 32 which project up through a pair of transversely-aligned apertures 34 in the backing strip 36 atop which the labels 38 are releasably fastened in longitudinally-spaced alignment. The labels are held in the well-known manner on the backing strip with a non-drying adhesive that permits them to be peeled off and fastened to a container once they have been printed. Control 40 that slides to and fro within slot 42 constitutes part of the shuttle subassembly and its function, as will be explained presently, is to adjust the "throw" of the shuttle to accommodate different length labels, i.e. different spacings between adjacent pairs of apertures 34.

Figure 10:
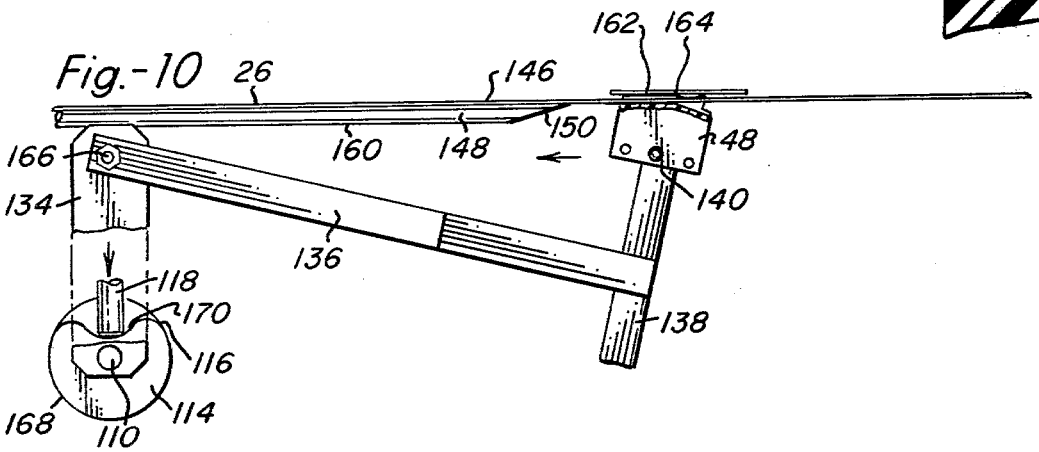

On/off switch 44 controls an electric motor drive 46 (FIG. 3) which operates both the shuttle and printing subassemblies. The shuttle subassembly functions to advance the label strip a label at a time beneath printing head 30 which remains elevated in its inoperative position while this strip-advancement part of the printing cycle is taking place. Then, while the strip remains stationary and the shuttle mechanism is operative to retract its slide block 48 (FIG. 10) to its starting position, the printing head moves down atop the label therebeneath, prints it and then returns to its original position preparatory to the next movement of the strip.

In the particular form shown, printing head 30 includes an ink pad 50 having an opening (not shown) in the top thereof bordered by an internally-threaded collar 52 into which the neck 54 of an ink bottle 56 screws in inverted position so as to continually supply ink thereto. The underside of the pad engages a stencil (not shown) which contains the information to be printed on the labels 38. A two-part clamp mechanism 58 receives and holds the subassembly that includes the pad and ink bottle between bifurcated spring fingers 60 thereof. Slot 62 enables the clamp and inking subassembly supported thereby to be adjustably mounted atop reciprocating post 64 where it is held in place by a large hollow bolt 66 which is both externally and internally threaded. This bolt screws into post 64 after passing loosely through a ribbed washer 68 that rides atop clamp mechanism 58 and slides non-rotatably along slot 62 therein.

Directing the attention next to FIGS. 1 and 2, the adjustable label guide subassembly 28 has a pair of movable rails 70 that cooperate to produce the track that guides the label strip into proper position beneath the printing head 30. These rails each include upper and lower plates 72 and 74, respectively, fastened one atop the other in face-to-face superimposed relation. The inner edges 76 of the upper plates project beyond the corresponding straight edges 78 of the lower plates cooperating therewith and with bedplate 26 therebeneath to produce opposed inwardly-opening slots 80 sized to receive and guide the side edges of the label strip along the track defined therebetween.

In FIG. 2 it can be seen that the bedplate 26 has several slots in it among which are center longitudinal slot 82 and rear and front pairs 84 and 86, respectively, of oppositely-inclined slots. Slots 84 and 86 on the same side of the center slot 82 parallel one another as shown while the slots of each pair are inclined at the same angle relative to the center one. A crossbar 88 bridges the gap between the rails at the rear end thereof where center slot 82 is located. This crossbar contains a pair of aligned transversely-extending vertical slots 90 that underlie both rails as well as the bedplate 26. Each slot has a widened portion 92 intermediate its ends that non-rotatably houses a hex-headed nut 94. Threaded into this nut from below is bolt 96 which is secured therein against rotation. Knobs 98, most clearly seen in FIG. 1, screw onto these bolts and lift the crossbar up against the underside of the bedplate 26 thus forcing the rails down atop thereof and holding them in adjusted position. A cap screw 100 screws down into the crossbar through center slot 82, the head thereof being larger than the shank as shown so as to support same on the portions of the bedplate bordering this slot when knobs 98 are loosened. Guidepins 102 of a diameter equivalent to the width of slot 82 cooperate with one another and with capscrew 100 to maintain the crossbar in essentially perpendicular relation to the rails at all times. Bolts 104 are longitudinally-aligned with bolts 96 but are located adjacent the front or discharge end of the rails in terms of label strip movement. These bolts pass through the rails and the slots 86 where a nut and washer subassembly (not shown) is loosely attached to the underside thereof.

Now, when knurled knobs 98 are loosened on bolts 96 and are used as a means to urge crossbar 88 back and fourth in slot 82, rails 72 move toward and away from one another simultaneously to vary the spacing therebetween while remaining at all times in parallel relation to one another. Once adjusted to the width of the particular label strip, knobs 98 are tightened down to maintain the rails in adjusted position. As this takes place, of course, bols 96 move toward and away from one another in the slots 90 in the crossbar as they also follow inclined slots 84 in the bedplate.

About the only other feature worthy of special mention in connection with the label strip guidance mechanism are the slightly upturned inside corners 106 found on the inwardly-extending flaps 108 provided on the intake ends of the upper rail plates 72. These flaps and upturned corners cooperate in guide the lead end of the label strip into grooves 80 as it comes off the supply reel.

Continuing on with FIGS. 1 and 2 and particularly the latter, a small fractional horsepower gear motor represented by output shaft 110 is fastened inside housing 112 and constitutes the drive mechanism 46 referred to previously. Housing 112 is secured to the underside of bedplate 26 and motor shaft 110 carries a cam 114 which turns therewith in the direction of the arrow in FIG. 3. Riding on shaped cam surface 116 is a pushrod-type cam follower 118 that projects downwardly from the underside of reciprocating post 64 through a guide hole 120 in stationary guide block 122 fastened to the motor housing 112. A guide rod 124 parallels cam follower 118 and reciprocates within sleeve bushing 126 mounted in a second guide hole 128 in the guide block. Guide rod 124 does not contact the cam, however, as its sole function is to cooperate with the cam follower to keep post 64 reciprocating vertically and prevent it from twisting. A tension spring 130 shown connected between the post and guide block normally biases the cam follower against the shaped surface 116 of cam 114. Actually, spring 130 is intended as being merely illustrative of a more complex tensioning arrangement by means of which the spring tension pressing the inking head down atop the label can be adjusted, not remain essentially constant as illustrated. Adjusting screw 132 (FIG. 1) screws down through the hollow internal threads of bolt 66 into engagement wth a rocker arm (not shown) connected to one end of the tension spring.

Motor shaft 110 also mounts a crank arm 134 which is operatively connected to slide block 48 of the shuttle subassembly 16 by a pitman-like rigid T-like 136. The crossbar portion 138 of this link is pivotally attached at its upper end to the underside of the slide block by transverse pivot pin 140; whereas, the lower end thereof connects to tension spring 142, the divergent legs of which extend upwardly to transversely-spaced points of attachment on brackets 144 hanging from the underside of the bedplate alongside but outboard of parallel slots 146 in the latter.e. The location of brackets is somewhere about midway between the limits of slide block movement, the extreme retracted position of which has been shown in full lines while its extreme extended position is represented by phantom lines. In both of these extreme positions, crossbar 138 of the T-link is slightly inclined rearwardly, i.e. toward the intake or rear end of the unit; however, for most of its excursion between these points of reversal, crossbar portion tilts forwardly as will be seen presently.

It should be apparent from the fact that since the length of crank arm 134 as well as that of T-link 136 are fixed, the length of travel of the slide block forward and back along slots 146 in the bedplate must remain the same. Notwithstanding this fact, the spacing between adjacent pairs of holes 32 in the label strip varies with the length of the labels and provision must, therefore, be made for deactivating the slide block through a portion of its forward excursion. The mechanism by means of which this is accomplished wll be described in detail next with specific reference to FIGS. 2, 3, 4 and 7.

Located beneath bedplate 26 and in between parallel slots 146 in a rod 148 terminating at its forwardmost extremity in an upwardly and forwardly-sloping ramp 150. Since it is necessary to keep the center of the unit clear for movement of the label strip and to accommodate the printing operation, the actuation of rod 148 must be offset to one side. A dogleg arm 152 (FIGS. 2 and 3) extends transversely from the rear extremity of rod 148 over to slot 42 in the inclined panel 154 of the case that also provides the situs of switch 44 and counter 156. A bolt (not shown) exends from arm 152 up through slot 42 and knurled nut 40 screws down onto it and against panel 154 to hold rod 148 in longitudinally-adjusted position.

Figure 7:
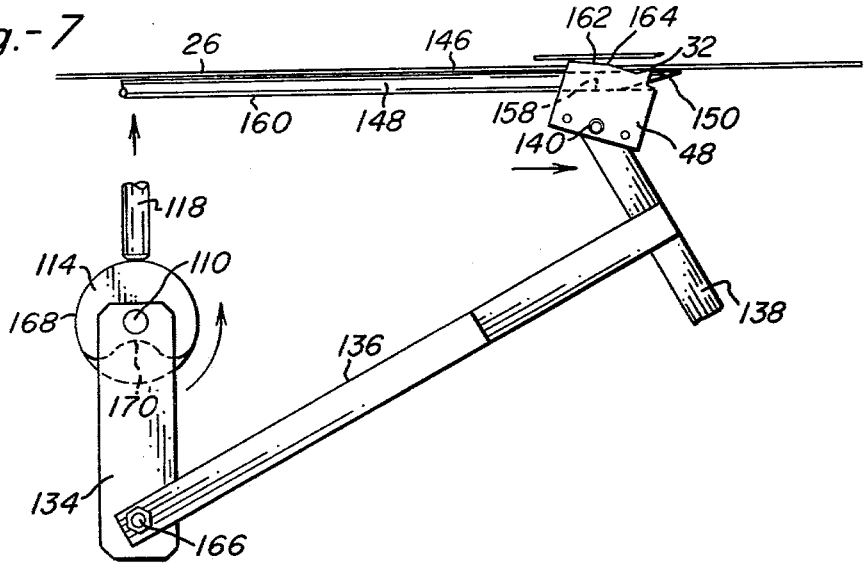
FIG. 7 is a fragmentary elevational detail to the same scale as FIG. 3 showing the shuttle subassembly during the early part of its forward stroke.

Directing the attention next to FIGS. 3, 4 and 7 and particularly to FIG. 4, slide block 48 will be seen to have a central groove 158 located midway of ears and extending longitudinally therebetween. This groove 158 is sloped relative to ears 32 such that the tips of the latter just barely clear the underside of the label strip (phantom lines in FIG. 4) yet remain in slots 146 while the block rides along under the cylindrical surface 160 of rod 148. In other words, groove 158 and rod surface 160 cooperate to tilt the slide block forwardly into the position best shown in FIG. 7 where the ear tips are retracted beneath the label strip thereabove. In addition, the rear end of the slide block is bias cut to produce rearwardly-sloping ramps 162 alongside groove 158 which enter slots 146 when the block is moved into forwardly-tilted position by rod 148, again as seen in FIG. 7. As these ramps 162 tilt up into the slots, they ride along the underside of the label strip and support same above the ear tips 32.

Figure 9:
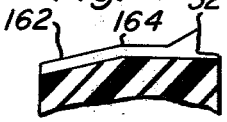
FIG. 9 is a greatly enlarged fragmentary section taken longitudinally through the slide block between the central groove therein and the ear-carrying upstanding ribs; and, FIG. 10 is a fragmentary elevational view much like FIGS. 7 and 8 and to the same scale revealing the return or retraction stroke of the shuttle subassembly as it functions to actuate the printing head.

Now, as the slide block approaches the forward end of rod 148 (FIGS. 4 and 7), the bottom of groove 158 therein is free to ride up ramp 150 thus permitting the slide block to tilt rearwardly projecting ears 32 up through slots 146 in the manner shown in FIG. 3. It is not this action, however, that actually tilts the slide block. Instead, there are a pair of hump-like fulcrums 164 formed atop the slide block alongside groove 158 and ahead of ramps 162 that ride along the underside of the bedplate adjacent slots 146, both of which are most clearly revealed in FIG. 9. It is these fulcrums in their relation to pivot 140 and the moment applied to the latter by crank arm 134 and link 136 that brings about the critical forward and back rocking action of the slide block. In other words, ramp 150 on rod 148 and groove 158 in the slide block do not coact to rock the latter rearwardly into its operative label-strip-advancing position, they only free it to do so.

In FIG. 7 it can be seen that all the time the slide block is moving forwardly along rod 148 with the crank arm 134 turning counterclockwise as shown, the resultant force applied through pivot 140 by T-link 136 is such as to pass ahead of fulcrum 164. This being the case, as soon as slide block 48 is free to do so, it will rock rearwardly about fulcrum 164 projecting the ears 32 up through slots 146 and presumably through the waiting apertures 34 in the label strip as well. As will be seen presently, the ears 32 always retract at the same point in their excursion along slots 146, once again determined by the relative positions of fulcrums 164 and pivot 140 when the shuttle subassembly reverses direction. The point of this is that knowing where the label strip, and particularly one of its sets of apertures 34, is going to end up when the strip stop momentarily, allows the operator to position the ramp 150 on the end of rod 148 approximately the length of one of the labels therebehind. In actual practice, the length of rod 148 in relation to slot 42 is chosen such that with a single label laid atop this slot with its right edge in alignment with the right end thereof, adjusting knob 40 such that about a $\frac{1}{4}$ inch gap is left between it and the left-hand edge of the label will set the shuttle correctly or nearly so. Minor adjustments one way or another are all that remain to be done to place the shuttle mechanism in full label-grip-advancing operation.

Figure 8:
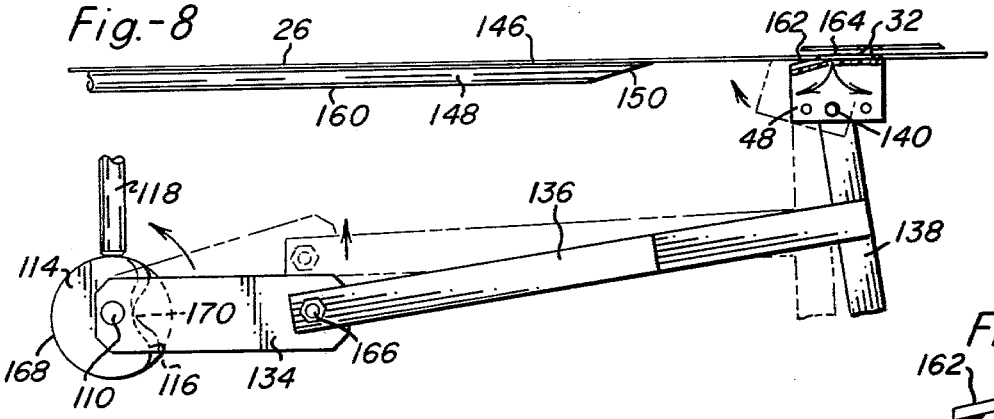
FIG. 8 is a fragmentary elevational detail much like FIG. 7 and to the same scale but differing therefrom in that it shows the slide block and associated crank and pitman drive therefor at the instant of reversal upon completion of the forward stroke.

FIG. 8 to which reference will now be made, most clearly delineats the action that takes place at the conclusion of the forward stroke of the shuttle subassembly. At this point, of course, slide block 48 has long since left rod 148 and is rocked rearward into its operative label-strip-advancing position. Just as it reaches the end of its forward stroke, the crank arm 134, T-link 136, pivot 140 and fulcrum 162 occupy the approximate positions shown in full lines in FIG. 8 with the crank, once again, rotating counterclockwise. At the instant the crank pivot 166 goes overcenter, i.e. crosses the straight line defined between the axis of rotation of the motor shaft 110 and pivot 140, it will begin to exert a pull on the slide block. The direction of this pull will pass through pivot 140 and ahead of fulcrum 164 thus immediately rocking the slide block forwardly about the latter as a pivot point, all of which has been represented by phantom lines in FIG. 8. Looking at the action another way, the pull on pivot point 140 will establish a clockwise moment around fulcrum 164 thus returning it to the forwardly-tilted fully retracted position shown in phantom lines in FIG. 8 in which position it remains until it once again rides off the end of rod 148 during the forward stroke. Note that the ramp 150 on the end of rod 148 performs no function whatsoever on the return stroke of the shuttle since the slide block is already tilted forwardly where the bottom of groove 158 therein will miss ramp 150 completely. Rod 148, therefore, is functional only on the operative or forward stroke of the shuttle.

Finally, with reference to FIGS. 3, 7, 8 and 10 of the drawings, the correlation between the movement of shuttle subassembly 16 and the actuation of printing subassembly 18 will be explained in detail as both are operated by the common drive shaft 110. Starting with FIG. 3, the shuttle subassembly as shown in full lines is just about to begin its forward stroke although, as previously noted, it may not yet be in position to advance the label strip since rod 148 may be holding the slide block in inoperative position. Nevertheless, at this point, the pushrod-type cam follower 118 will ride up onto the cylindrical surface 168 of cam 114 thus raising the printing head 30 into its inoperative position. Moreover, it stays in this position until the cam and associated linkage reach the phantom line position of FIG. 8 where, as previously noted, the slide block has been rocked forward into its inoperative or disengaged position preparatory to starting on its return stroke. All label strip movement has stopped at this point and cam follower 118 drops down into the valley 170 in shaped surface 116 thus enabling spring 130 to pull the printing head down onto the label waiting therebeneath. It rides back up out of valley 170 and returns to its inoperative position (FIG. 3 again) well in advance of the shuttle starting its forward stroke.

What is claimed is:

1. The apparatus for imprinting labels one-at-a-time while detachably-fastened in longitudinally-spaced relation to the surface of a backing strip having at least one aperture in the space between adjacent labels comprising: an elongate flat bedplate having at least one slot extending longitudinally thereof; track-forming means disposed atop said bedplate adapted to receive the label strip and guide same along the slot so that one of the apertures therein remains in registry therewith; a printing head mounted for movement upon actuation between an elevated inoperative position above the label strip and an operative position in indicia-forming contact therewith; a shuttle subassembly disposed beneath the slot in the bedplate for advancing the label strip and placing the labels one-at-a-time underneath the printing head, said assembly including a transversely-extending drive shaft, a crank arm mounted on said drive shaft for rotational movement therewith in a vertical plane paralleling the slot in the bedplate, a slide block having an upper surface disposed for sliding movement along the underside of the bedplate beneath the slot therein, said surface including an upstanding rib sized for guided movement along the bedplate slot and a fulcrum alongside said rib bearing against a portion of the bedplate adjacent said slot, said rib including an ear engageable within the registering aperture in the label strip effective to advance same upon forward movement of the slide block, and said fulcrum mounting said slide block for rockable movement between a rearwardly-tilted operative position wherein said ear is extended to engage the label strip and a forwardly-tilted inoperative position wherein said ear is retracted beneath said label strip, and a rigid link having opposite ends pivotally connected to the crank arm and slide block at a point spaced from the fulcrum, said link being operative upon rotation of the crank to shuttle the slide block back and forth, said crank arm and link cooperating with one another and with the slide block to tilt the latter rearwardly when pushing it forwardly and to tilt same forwardly when pulling it rearwardly, and the pivotal connection between said link and slide block being so arranged relative to the fulcrum carried by the latter as to tilt same between its operative and inoperative positions when the direction of motion of said slide block reverses; and, cam means carried by said drive shaft for rotation therewith, said cam means being connected to said printing head and effective upon rotation to reciprocate same between its operative and inoperative positions, and said cam being oriented on said shaft in relation to the crank means so as to move the printing head into operative position during the return stroke of the shuttle subassembly when the slide block is inoperative.

2. The strip label printing apparatus as set forth in claim 1 wherein means defining a longitudinally-extending rib is mounted on the underside of the bedplate paralleling the slot therein and aligned with the movement of the slide block, and wherein said upper slide block surface contains a longitudinally-extending groove sized to receive and ride along said rib defining means, said groove being inclined relative to the slide block rib so as to coact with said rib-defining means to hold the slide block tilted forwardly into its inoperative position when thus interengaged.

3. The strip label printing apparatus as set forth in claim 1 wherein the fulcrum is hump-like and defined by adjacent oppositely-inclined ramps on said upper slide block surface.

4. The strip label printing apparatus as set forth in claim 1 wherein the slide block rib is sloped behind the ear to produce an inclined surface adapted to ride essentially flush with the upper surface of the bedplate when the slide block is tilted forwardly into its inoperative position.

5. The strip label printing apparatus as set forth in claim 1 wherein the link is T-shaped and includes a stem portion and a crossbar portion, said stem portion being pivotally connected to the crank arm at a point spaced from the crossbar portion, and said crossbar having upper and lower ends, said upper end being pivotally attached to the slide block and said lower end being connected to the spring means.

6. The strip label printing apparatus as set forth in claim 4 in which the rib-defining means is connected to the underside of the bedplate for longitudinal adjustment so as to vary the point during the forward movement of the slide block that the latter is released for rearward tiltable movement into its operative position.

7. The strip label printing apparatus as set forth in claim 4 wherein the rib-defining means comprises an elongate rod.

8. The strip label printing apparatus as set forth in claim 7 wherein the forward end of said rod is shaped to produce an upwardly and forwardly sloping ramp.

* * * * *